US006502552B2

(12) United States Patent
Lee

(10) Patent No.: US 6,502,552 B2
(45) Date of Patent: Jan. 7, 2003

(54) WIRING CONNECTION FOR FUEL INJECTORS

(75) Inventor: Ki-Ho Lee, Windsor (CA)

(73) Assignee: Siemens VDO Automotne Inc., Tilbury (CA)

( * ) Notice: Subject to any disclaimer, the term of this patent is extended or adjusted under 35 U.S.C. 154(b) by 0 days.

(21) Appl. No.: 09/970,732

(22) Filed: Oct. 4, 2001

(65) Prior Publication Data

US 2002/0046721 A1 Apr. 25, 2002

Related U.S. Application Data

(60) Provisional application No. 60/243,189, filed on Oct. 25, 2000.

(51) Int. Cl.[7] ..... F02M 55/02

(52) U.S. Cl. ..... 123/456; 123/469

(58) Field of Search ..... 123/456, 477, 123/468, 469, 470, 143 C, 472

(56) References Cited

U.S. PATENT DOCUMENTS

| | | | | |
|---|---|---|---|---|
| 4,570,601 A | | 2/1986 | Ito et al. | |
| 5,030,116 A | * | 7/1991 | Sakai et al. | 123/470 |
| 5,127,382 A | | 7/1992 | Imoehl | |
| 5,209,204 A | | 5/1993 | Bodenhausen et al. | |
| 5,350,314 A | * | 9/1994 | Saba | 123/456 |
| 6,260,537 B1 | * | 7/2001 | Lamb et al. | 123/456 |

FOREIGN PATENT DOCUMENTS

| | | |
|---|---|---|
| FR | 2772996 | 6/1999 |
| JP | 09264226 | 7/1997 |

* cited by examiner

*Primary Examiner*—Bibhu Mohanty

(57) ABSTRACT

A fuel delivery system comprises fuel rail (26), at least one fuel injector (30), a flex cable (72) extending along a length of the fuel rail (26), and lead (70) extending from the flex cable (72). (FIG. 2). Lead (70) extends to an electrical connector (34). (FIG. 2). Electrical connector (34) connects to the fuel injector 930) and attaches to the fuel rail (26).

16 Claims, 4 Drawing Sheets

WIRING CONNECTION FOR FUEL INJECTORS

This application claims priority to Provisional Patent Application Serial No. 60/243,189 filed on Oct. 25, 2000.

BACKGROUND OF THE INVENTION

This application relates to a fuel distribution system including a flex cable for communicating electrical signals to the fuel injectors, and wherein leads from the flex cable are supported on the fuel conduit to provide better support and ease of assembly features.

Fuel distribution systems provide fuel to the combustion chambers of a vehicle engine. Typically, a fuel rail or conduit carries fuel from the vehicle's tank to fuel injectors above each chamber. The injectors are actuated electrically to spray fuel into each chamber. Because each injector is powered electrically, the injector requires a wire connection from the vehicle's electrical system.

To reduce weight it has been proposed to use flex cables to carry power along the fuel conduit. Flex cables as proposed would have thin wire leads that extend from the flex cable body to electrical connectors. The connectors used to join the flex cable to the fuel injector are thus spaced from the cable and unsupported on the fuel rail. This design may result in a loose wire connection or even flexing of the end of the lead adjacent the flex cable that could result in the lead breaking.

Additionally, fuel distribution systems are currently manufactured by separately installing the fuel rail onto the fuel injector and then making the necessary electrical connections from the flex cable to each fuel injector. This two step process results in lost time and labor. Moreover, the fuel rail is frequently packaged separately from the wire connectors used for the fuel injectors, leading to further expense in the assembly process.

A need therefore exists for a simplified and less cumbersome way to make the wire connections and fuel rail connections to the system's fuel injectors.

SUMMARY OF THE INVENTION

The invention comprises a fuel delivery system having a fuel rail, a plurality of fuel injectors for receiving fuel from the fuel rail, a flex cable extending along the fuel rail, and leads from the flex cable to a plurality of electrical connectors attached to the fuel injector. In contrast to proposed fuel delivery systems, the invention holds the electrical connector on the fuel rail. In this way, the electrical connector and the fuel conduit form a single unit that may be quickly and easily installed to make the necessary electrical and fuel port connections generally in one single step. Holding the connector on the fuel rail provides better support and a better electrical connection.

The electrical connector itself may attach to the fuel conduit by a snap-fit connection. The snap-fit connection may have legs that extend from the fuel rail to support the electrical connector. The legs may further extend around a groove on the electrical connector to provide a secure manner to hold the electrical connector in place. The flex cable may also be supported in place by such support as a foam gasket.

Accordingly, a combined flex cable and fuel rail is assembled. The fuel rail is then aligned with the fuel injectors to permit the necessary electrical and fuel port connections to be made. These connections are made by insertion of the fuel rail over the fuel injectors. Thus, the necessary electrical connections and fuel port connections may be made in fewer steps.

BRIEF DESCRIPTION OF THE DRAWINGS

The various features and advantages of this invention will become apparent to those skilled in the art from the following detailed description of the currently preferred embodiment. The drawings that accompany the detailed description can be briefly described as follows.

DETAILED DESCRIPTION OF THE PREFERRED EMBODIMENT

Figure 1A:
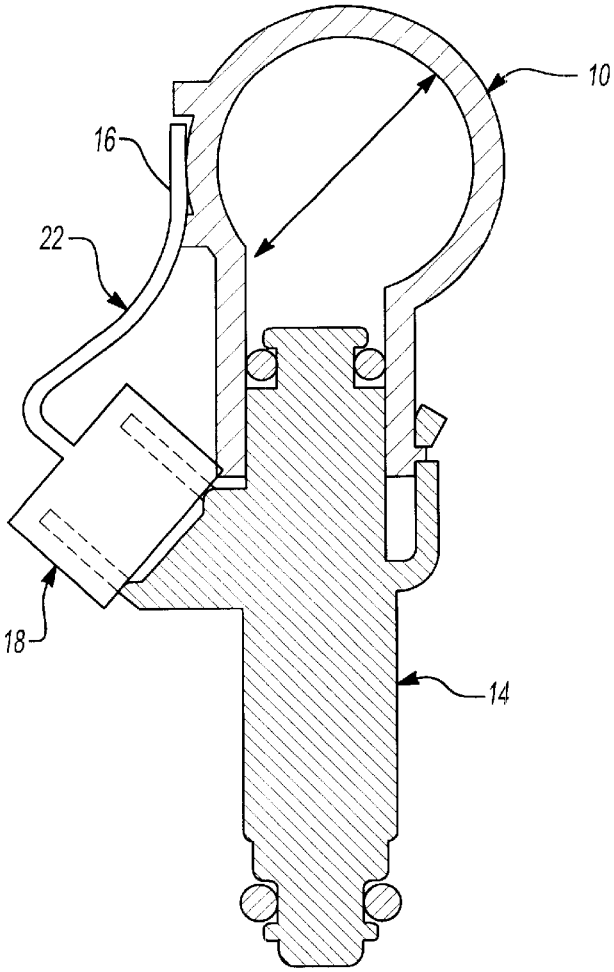
Fig-1A PRIOR ART
FIG. 1A illustrates a fuel conduit with an electrical connection.
Figure 1B:
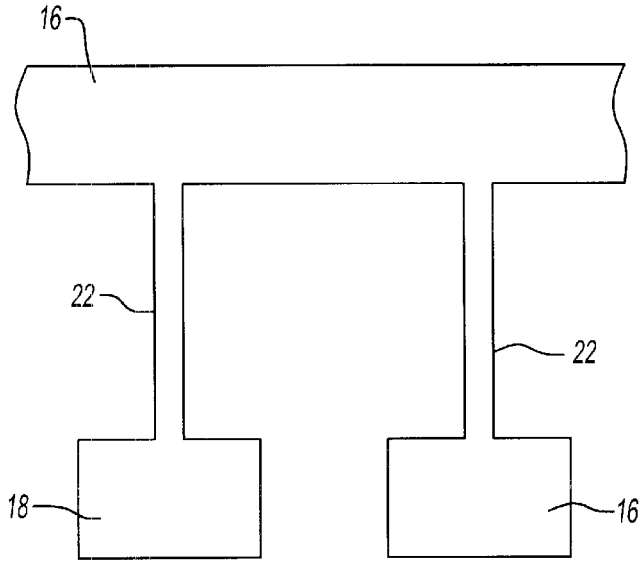
FIG. 1B shows the flex cable of FIG. 1.

FIGS. 1A and 1B illustrate a proposed fuel delivery system, including fuel rail 10, fuel injector 14, a flex cable 16, electrical connector 18, and flex cable lead 22 connecting cable 16 to electrical connector 18. The fuel delivery system is assembled by first installing fuel conduit 10 onto each fuel injector 14. Then, second electrical connector 18 is inserted onto fuel injector 14. Thus, two steps are required to make the necessary fuel conduit 10 and electrical connector 18 connections to fuel injector 14. Since the connector 18 is unsupported on the fuel rail 10, there is the possibility of relative flexing along the lead 22. In particular, if fuel injector 14 flexes relative to the fuel rail 10, there is the possibility of flexing or bending of the end of the lead 22 adjacent the flex cable 16. This would be undesirable. It should also be understood for purposes of this application that the fuel injectors are shown as simple solid elements. Of course, they include complex electrical and fluid delivery structure which is omitted here to simplify an understanding of the inventive features of this application.

Figure 2:
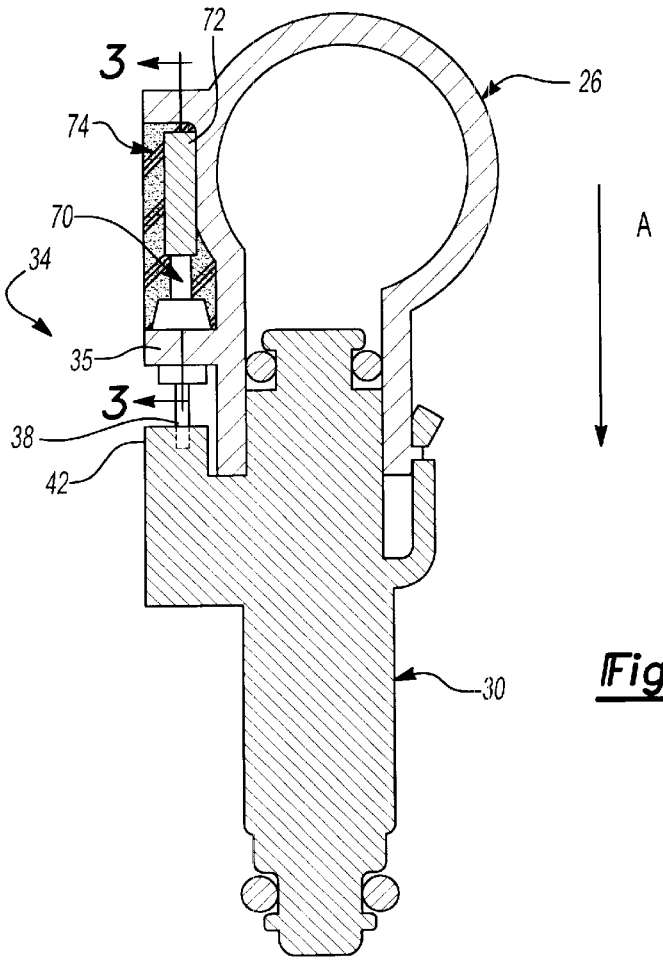
FIG. 2 shows an embodiment of the invention.

FIG. 2 illustrates an embodiment of the invention comprising fuel rail 26, fuel injector 30, and electrical connector 34. A flex cable 72 extends along fuel rail 26, and leads 70 extend from cable 72 to electrical connector 34. Electrical connector 34 is held on fuel conduit 26 by structure 35 as well as connected to fuel injector 30. Holding connector 34 on fuel conduit 26 provides significantly greater support to electrical connector and lead 70. Indeed, to further keep flex cable lead 70 from tearing away, support 74, such as a foam gasket, may be used to support flex cable lead 70.

Figure 3:
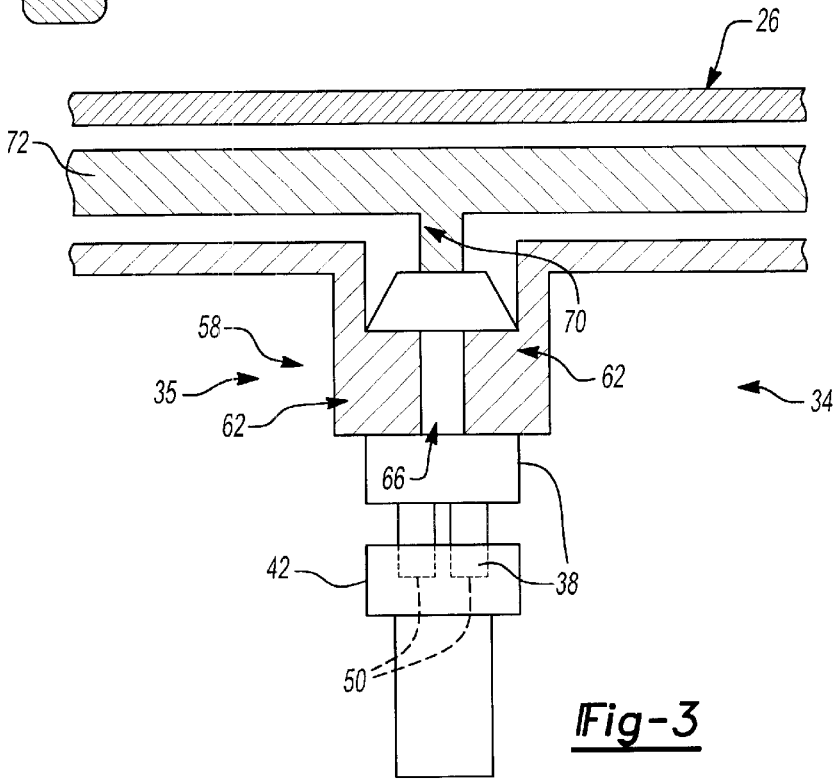
FIG. 3 is a view along line 3—3 of FIG. 2.
Figure 4:
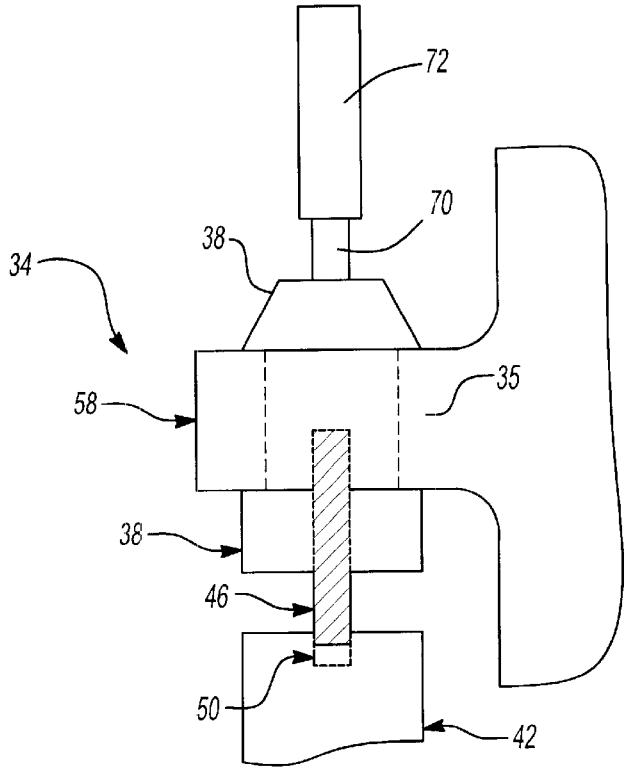
FIG. 4 shows a close up view of the electrical connector of FIGS. 2 and 3.

FIG. 3 illustrates a sectional view of FIG. 2. Shown are fuel rail 26, electrical connector 34, and flex cable lead 70. Also shown is flex cable 72. As seen from this side view, structure 35 includes at least two legs 62 that extend around a groove 66 in connector 34. Electrical connector 34 comprises male connector 38 which connects to a female connector 42 on the fuel injector. Of course, the connector 34 could have the female connector portion with the male being on the fuel injector. As shown in FIG. 3 and FIG. 4, the connector has two conductive contacts 38 that fit into two conductive receptacles 50 on the fuel injector. This plug-type connection permits a quick and secure electrical connection.

As shown in FIG. 3 and FIG. 4, electrical connector 34 attaches to fuel rail 26 through structure 34 that includes a snap-fit connection 58 from legs 62. Snap-fit connection 58 comprises two legs 62 that captive groove 66 on connector 38.

Figure 5:
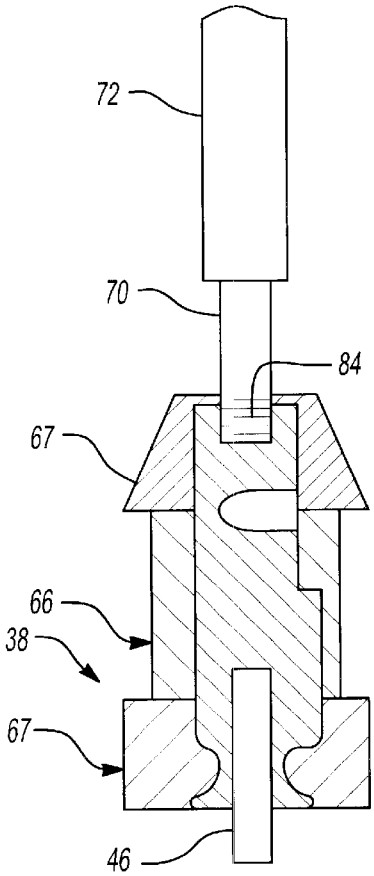
FIG. 5 shows the electrical connector.
Figure 6:
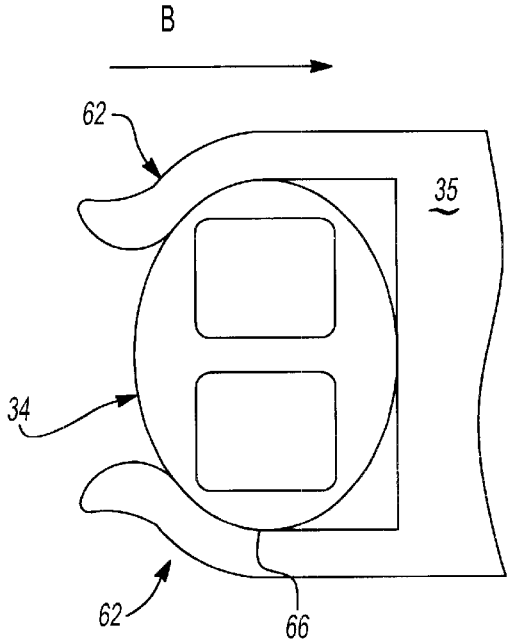
FIG. 6 shows a top view of the electrical connector, illustrating the snap fit connection to the fuel conduit.

As shown in FIG. 5, male connector 34 has groove 66 between upper and lower larger lands 67 to receive legs 62 shown in FIG. 6. In addition, connector 34 receives flex cable lead 70 which is connected to contacts 38 through some means 84, as may be well known.

Figure 7:
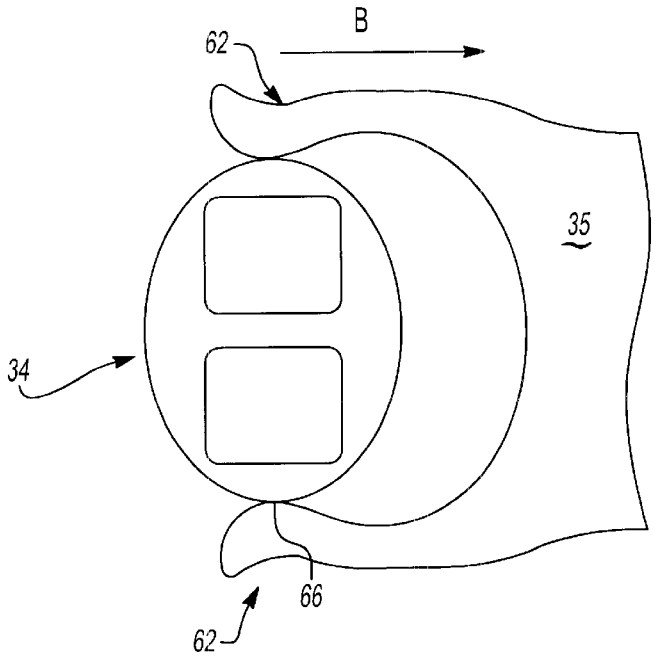
FIG. 7 shows a top view of the electrical connector, illustrating the connection snapping to the fuel conduit.

As seen in FIG. 6, legs 62 extend around connector 34. FIG. 7 illustrates the snap-fit connection 34 receiving electrical connector 34. Connector 34 is inserted into legs 62 by moving in the direction of arrow B. Contact by connector 34 with legs 62 forces legs 62 to bend outward to receive connector 34. Once connector 34 has been inserted far enough between legs 62, legs 62 snap back in place so as to secure connector 34 to fuel rail 26.

Figure 8:
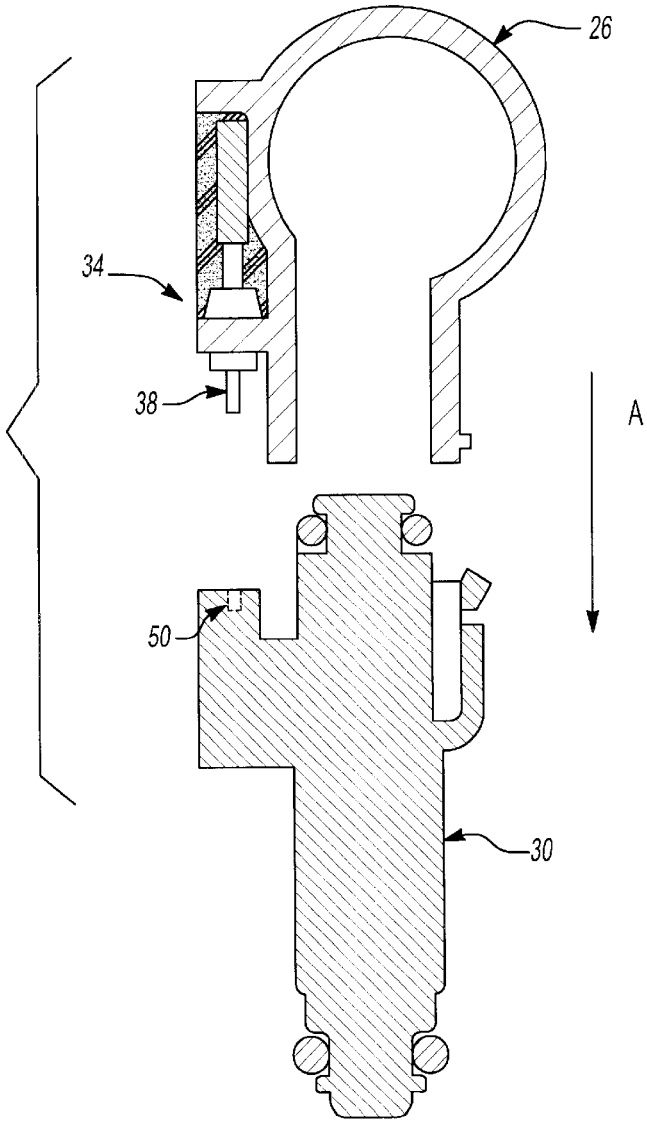
FIG. 8 shows the insertion of the fuel conduit over the fuel injector.

As shown in FIG. 8, contacts 38 of electrical connector 34 inserts into conductive receptacles 50 along the same direction, arrow A, as fuel rail 26 is moved onto fuel injector 30. Both the electrical connection and the fluid connections are thus made along the direction of arrow A. Electrical connector 34 and fuel conduit 26 are aligned with respect to fuel injector 30. Then, electrical connector 34 and fuel conduit 26 may be connected to fuel injector 30 simultaneously by inserting a pre-assembled electrical connector 34 and fuel rail 26 along the direction of arrow A. The attachment of electrical connector 34 to fuel conduit 26 permits the single step attachment of the assembly to fuel injector 30.

The aforementioned description is exemplary rather that limiting. Many modifications and variations of the present invention are possible in light of the above teachings. The preferred embodiments of this invention have been disclosed. However, one of ordinary skill in the art would recognize that certain modifications would come within the scope of this invention. Hence, within the scope of the appended claims, the invention may be practiced otherwise than as specifically described. For this reason the following claims should be studied to determine the true scope and content of this invention.

What is claimed is:

1. A fuel delivery system comprising:

a fuel rail;

at least one fuel injector in communication with said fuel rail;

a flex cable extending along a length of said fuel rail, and at least one lead extending from said flex cable to an electrical connector, said electrical connector connected to said fuel injector; and said electrical connector being attached to said fuel rail.

2. The fuel delivery system of claim 1 wherein said electrical connector attaches to said fuel rail through a snap-fit connection.

3. The fuel delivery system of claim 2 wherein said snap-fit connection comprises at least two legs extending from said fuel rail that support said electrical connector.

4. The fuel delivery system of claim 3 wherein at least two legs extend around a groove on said electrical connector.

5. The fuel delivery system of claim 1 wherein a support further supports said lead and said flex cable on said fuel rail.

6. The fuel delivery system of claim 5 wherein support includes a foam gasket.

7. The fuel delivery system of claim 1 wherein said electrical connector is connected to said fuel rail to support said lead between said electrical connector and said flex cable.

8. A fuel delivery system comprising:

a fuel rail extending along a length;

a plurality of fuel injectors in communication with said fuel rail;

a flex cable extending along said fuel rail, and a plurality of leads extending from said flex cable to a plurality of electrical connectors, said electrical connectors each being connected to one of said fuel injectors; and said leads and said electrical connectors being supported on said fuel rail adjacent and remote from said flex cable.

9. A fuel delivery system as recited in claim 8 wherein said electrical connector is connected to said fuel rail.

10. The fuel delivery system of claim 9 wherein said snap-fit connection comprises at least two legs extending from said fuel rail to hold said electrical connector.

11. The fuel delivery system of claim 10 wherein at least two flexible legs extend around a groove on said electrical connector.

12. The fuel delivery system of claim 8 including a support to support said lead on said fuel rail.

13. The fuel delivery system of claim 12 wherein said support comprises a foam gasket.

14. A method of assembling a fuel distribution system comprising the steps of:

attaching a flex cable having leads extending to an electrical connector to a fuel rail, with said electrical connector being mounted on said fuel rail;

aligning the electrical connector and the fuel rail with respect to a fuel injector; and connecting the electrical connector and the fuel rail to the fuel injector.

15. The method of claim 14 wherein the electrical connector snaps to the fuel rail.

16. The method of claim 15 wherein said electrical connector snaps between two resilient legs to be held on said fuel rail.

* * * * *